US006571529B2

(12) United States Patent
Knudson et al.

(10) Patent No.: US 6,571,529 B2
(45) Date of Patent: Jun. 3, 2003

(54) ENVIRONMENT RESISTANT RETAINING WALL BLOCK AND METHODS OF USE THEREOF

(75) Inventors: Edward Alan Knudson, Zimmerman, MN (US); John Fitzgerald Dolan, Golden Valley, MN (US)

(73) Assignee: New Technology Resources, Inc., Golden Valley, MN (US)

( * ) Notice: Subject to any disclaimer, the term of this patent is extended or adjusted under 35 U.S.C. 154(b) by 0 days.

(21) Appl. No.: 09/736,598

(22) Filed: Dec. 13, 2000

(65) Prior Publication Data

US 2002/0069595 A1 Jun. 13, 2002

(51) Int. Cl.[7] ..... E04B 5/08

(52) U.S. Cl. ..... 52/745.05; 52/504; 52/603; 52/604

(58) Field of Search ..... 52/503, 504, 505, 52/421, 439, 438, 604, 606, 569, 745.05, 745.09; 446/128, 121; 405/284, 262, 273; 220/4.26, 4.27

(56) References Cited

U.S. PATENT DOCUMENTS

| | | | | |
|---|---|---|---|---|
| RE34,314 | E | | 7/1993 | Forsberg |
| 5,294,216 | A | | 3/1994 | Sievert |
| 5,471,808 | A | * | 12/1995 | DePieri et al. ..... 52/603 |
| 5,688,079 | A | | 11/1997 | Bolduc et al. |
| 5,832,687 | A | * | 11/1998 | Willemsen ..... 52/592.6 |
| 6,024,626 | A | * | 2/2000 | Mendelsohn ..... 446/92 |
| 6,062,772 | A | | 5/2000 | Perkins |
| D429,004 | S | | 8/2000 | Strand et al. |
| 6,113,317 | A | * | 9/2000 | Myers ..... 405/284 |

* cited by examiner

*Primary Examiner*—Carl D. Friedman
*Assistant Examiner*—Jennifer I. Thissell

(57) ABSTRACT

The present invention relates to a retaining wall block that is resistant to damage and wear caused by the environment it is placed into. The deterioration resistant block is generally a hollowed frame or shell of a deterioration resistant material that is lightweight and is configured to accept and retain any type of filling material. The filling material provides weight and stability to the retaining wall block and also provides weight, stability and security to a retaining wall constructed of such blocks.

20 Claims, 8 Drawing Sheets

ENVIRONMENT RESISTANT RETAINING WALL BLOCK AND METHODS OF USE THEREOF

The present invention relates to a retaining wall block that is resistant to damage and wear caused by the environment it is placed into. The deterioration resistant block is generally a hollowed frame or shell of a deterioration resistant material that is light-weight and is configured to accept and retain any type of filling material. The filling material provides weight and stability to the retaining wall block and also provides weight, stability and security to a retaining wall constructed of such blocks.

BACKGROUND OF THE INVENTION

The use of retaining walls to protect and beatify property in all types of environmental settings is a common practice in the landscaping, construction and environmental protection fields. Walls constructed from various materials are used to outline sections of property for particular uses, such as gardens or flower beds, fencing in property lines, reduction of erosion, and to simply beautify areas of a property.

Numerous methods and materials exist for the construction of retaining walls. Such methods include the use of natural stone, poured in place concrete, masonry, landscape timbers or railroad ties. In recent years, segmental concrete retaining wall units, sometimes known as keystones, which are dry stacked (i.e., built without the use of mortar), have become a widely accepted product for the construction of retaining walls. Examples of such units are described in U.S. Pat. No. RE 34,314 (Forsberg) and in U.S. Pat. No. 5,294,216 (Sievert).

However, many of the materials utilized in the construction of retaining walls are susceptible to deterioration and/or are not very aesthetically appealing. The ability of these retaining walls to withstand sunlight, wind, water, general erosion and other environmental elements is a problem with most retaining wall products.

A particular concern is the utilization of erosion protection materials in water shorelines. Leaving the shoreline natural can lead to erosion, cause an unmanageable and unusable shoreline, create high maintenance, and inhibit an aesthetically pleasing property. Many materials utilized in retention of shorelines are subject to immediate deterioration and/or are not as aesthetically appealing as one would desire. Furthermore, many materials utilized on shoreline structures are difficult to maintain due to the awkward location in the water and also the prevalent growth and presence of organic materials that can get caught and flourish in such a structure. For example, many lakeshore or ocean side properties utilize riprap as a retention device for prevention of erosion. Riprap is a configuration of large to medium size stones placed along the shoreline. A problem with waterfront properties that use a continuous wall of typical riprap is the shoreline will retain some organic material or will accumulate additional organic material brought in by the water. This usually leads to an unmanageable and aesthetically displeasing shoreline or higher maintenance. Furthermore, the riprap is never uniform in color and size and therefore does not as provide the most aesthetically pleasing shoreline or complete coverage of the shoreline. The lack of uniform shoreline coverage allows for some erosion, collection of various materials and the growth of weeds.

Another problem with materials normally utilized in the construction of retaining walls, such as poured in place concrete, masonry, landscape timbers, railroad ties or keystones is that regulations in most states and counties prohibit their use in or near bodies of water because of the crumbling or deterioration of the material into the body of water over time. Many of these retaining wall materials dissolve, crumble, break apart and/or float into the body of water for which they line causing problems with the shoreline and pollution of the water. For example, the average life of a concrete block or keystone in water is approximately a couple of years. A need exists for a retaining wall, which would be resistant to such deterioration.

An additional concern that exists in the construction of retaining walls is the weight of the materials. Concrete blocks, large stones, timbers or keystones can be heavy to move into the wall location and maneuver when constructing the wall. Many locations for which retaining walls are constructed are positioned in awkward terrain. Heavy building materials are difficult to move into the location and furthermore are difficult to position when constructing the retaining wall thereby adding additional cost and labor for installation. However, the heavy materials are needed once the wall is constructed to provide stability and security to the structure. Therefore, the easy to install light-weight units used for the construction of a retaining wall, which can be weighted once placed into position thus retaining the block in position and stabilizing the completed retaining wall, would be beneficial to construction of such structures.

SUMMARY OF THE INVENTION

As previously mentioned the present invention relates to a retaining wall block that is resistant to damage and wear caused by the environment it is placed into. The deterioration resistant block is generally a hollowed frame or shell of a deterioration resistant material that is light-weight and is configured to accept and retain any type of filling material. The filling material provides weight and stability to the retaining wall block and also ultimately provides stability and security to the retaining wall constructed of such blocks. More specifically, the deterioration resistant block comprises a top panel, a bottom panel, a wall assembly and an optional anchoring device. One or more chambers are created by adjoining the top panel, bottom panel and wall assembly. The chambers are adapted for receiving and retaining fill materials, such as sand, dirt, gravel, pea rock, or any other similar material, which provides the permanent weighting and stability of the retaining wall block.

Embodiments of the present invention are comprised of a deterioration resistant retaining block for use in constructing retaining walls on a number of property terrains, such as along waterfront properties. The deterioration resistant blocks are particularly useful for terrains near water or underwater due to their resistance to degradation. However, the deterioration resistant blocks could also be used for land applications for those that want a light-weight retaining wall block that can be filled on-site to add weight and stability and doesn't require heavy equipment for moving. Therefore, the deterioration resistant retaining wall block could be utilized to construct any form of wall or fence structure.

One unique feature of the present invention is the light-weight characteristic of the block before it is filled. As previously mentioned, embodiments of the present invention can be waterproof and may be filled with any type of fill material located at the site, such as rocks, sand, gravel, soil, pea rock or similar materials. The filling characteristic of the deterioration resistant block means that when the block is not filled it is very light-weight. The light-weight feature provides individuals constructing such walls the advantage of easily moving large numbers of the blocks to the site of construction with relative ease. Furthermore, the lightweight characteristic of the blocks allows for easy maneuvering of the blocks into final position when constructing the wall and still allows for the stability of a heavy block after it is filled. These characteristics are met by the block being made of a lightweight material and also configured to receive a heavy fill material once it is about to be placed or has been placed in its final position on the retaining wall.

Embodiments of the present invention further fills an unmet landscaping need for shorelines in that the deterioration resistant blocks are easily manufactured. Examples of possible manufacturing methods include but are not limited to injection-molding and blow-molding. Also any high volume application for production may be utilized in manufacturing the present invention. The individual units are lightweight, attractive, easy to install, prevent shoreline and other terrain erosion and compliment existing retaining wall block. The deterioration resistant blocks are also waterproof, can withstand ice damage due to their flexible nature and are easily replaced in case of damage. Furthermore, they are rugged and very low maintenance. Additionally, embodiments of the present invention are easily transportable and storable due to their light-weight and possible stacking features.

Individuals would be more inclined to install block made of a deterioration resistant material themselves rather than cement block, timbers, keystones and the like, because of the ease of installation, due to the lightweight material and also the longevity of the block. The minimum weight of most regular garden block is approximately 30–50 lbs, whereas embodiments of the present invention may be approximately 0.1–10 lbs. Of course, weight may vary depending on the size and materials utilized in manufacturing embodiments of the present invention. Also, as previously mentioned the blocks of the present invention retain the final stability and weight by filling the block with an appropriate fill material either prior to or after it has been permanently installed.

As previously suggested, embodiments of the present invention are also resistant to deterioration, such as wear, crumbling and breaking, therefore, the deterioration resistant block does not have to be replaced as often and/or increases the lifespan of the retaining wall. The block has approximately the lifespan of at least 5–10 times the life of a regular keystone. The increased lifespan of the block translates to fewer or no occurrences of replacement of individual blocks or the potential complete reconstruction of the entire wall. Furthermore, retaining wall materials, such as concrete block, timbers and keystone, are typically not used in water applications because they dissolve, crumble and/or break down over time and exposure. The durability and resistant characteristics of the present invention reduce and prevent this deterioration, therefore making it very beneficial for all applications that come in contact with water.

Another consideration relating to the water application of embodiments of the retaining wall block of the present invention is the block's resistance to ice damage when installed around a body of water when it freezes. When ice expands and/or moves it shifts, tears and damages various types materials utilized for shoreline retention, such as keystone, concrete block, rip rap, landscape timbers or anything rigid. Embodiments of the present invention can be manufactured with a material that has flexibility and would flex in a similar way as a Rubbermaid® trash can flexes. Considering that the deterioration resistant block would be filled with a fill material, the deformation would be minimal, but still enough to prevent damage to the retaining wall block and/or the entire wall. Furthermore, upon melting or shifting of the ice the deterioration resistant block would return to its original configuration.

Another advantage of embodiments of the present invention relates to the high cost of waterfront property and people's inclination to improve their property to keep it well-maintained and aesthetically pleasing. As previously mentioned riprap, is commonly stack up along property shorelines to prevent erosion. The trouble with this shoreline preservation application is that the rock leaves many crevices for organic material to reside and, since it is close to water, the crevices are prominent areas for the growth of vegetation. The advantage of embodiments of the present invention is that they fit next to each other and prevent organic material from getting in-between the blocks, therefore preventing vegetation from growing in such structures.

In addition, many waterfront properties suffer water damage when water levels rise above the shoreline. The retaining wall block of the present invention is a solution to water retention and erosion problems in such areas of threatening high or rising water levels. Furthermore, the retaining wall block poses a solution in locations where there is a flood plane or areas that are washed out by any type of water movement. Sandbags have been a solution to such problems, but are not a permanent or aesthetically pleasing solution. The retaining wall block can replace sand bags in an area for which a more permanent and aesthetically pleasing alternative is desired.

As previously suggested, the deterioration resistant retaining wall block can comprise any type of shape, configuration, color and design. In addition the retaining wall block may include any design or color located anywhere on any panel or wall of the block. Furthermore, the utilization of conventional type materials for retaining walls, such as concrete blocks, timbers or keystones, are heavy to install and do not provide long term or permanent solutions, due to the previously mentioned deterioration problems. Therefore, the present invention provides an aesthetically pleasing solution and replacement for materials, including sandbags, presently utilized in retaining wall construction.

DETAILED DESCRIPTION OF THE INVENTION

Figure 1:
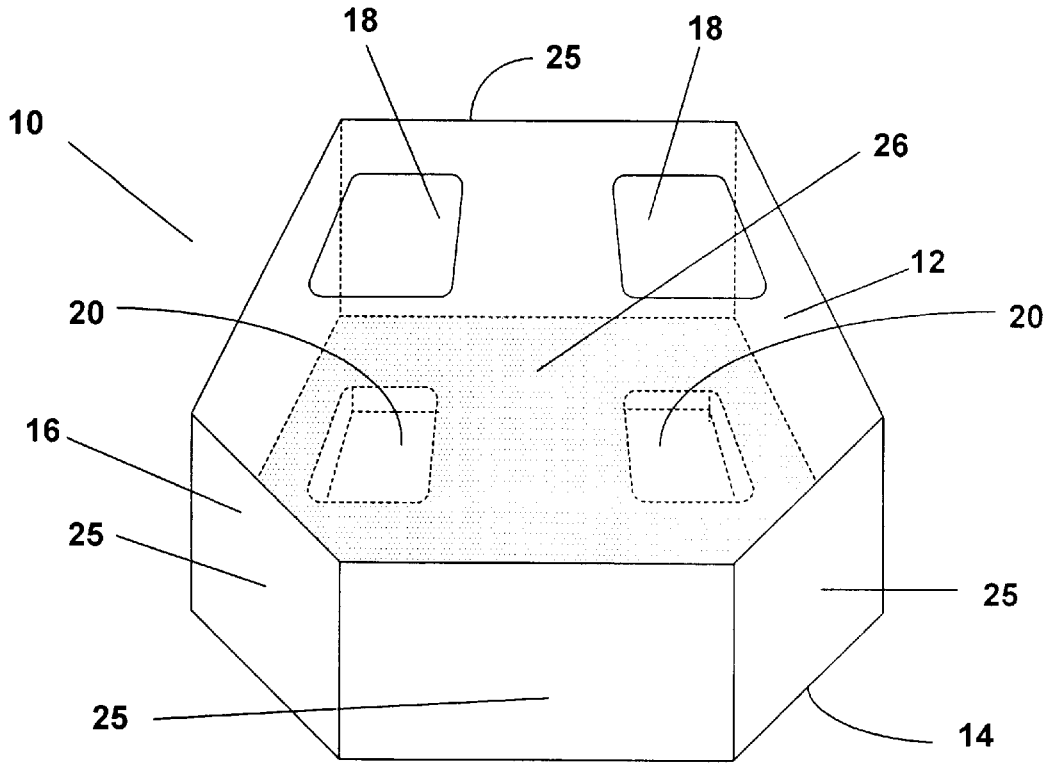
FIG. 1 is a perspective view of one embodiment of a deterioration resistant retaining wall block.

FIG. 1 depicts one embodiment of the deterioration resistant retaining wall block 10 comprising a top panel 12, a bottom panel 14 and a wall assembly 16. FIG. 1 illustrates the top panel 12, which includes one or more apertures 18. The apertures 18 may be of any size and shape suitable for the receiving of fill material. The bottom panel 14 includes a relatively flat surface or contoured to rest uniformly with the top panel 12 of one or more blocks 10 positioned below.

Figure 2:
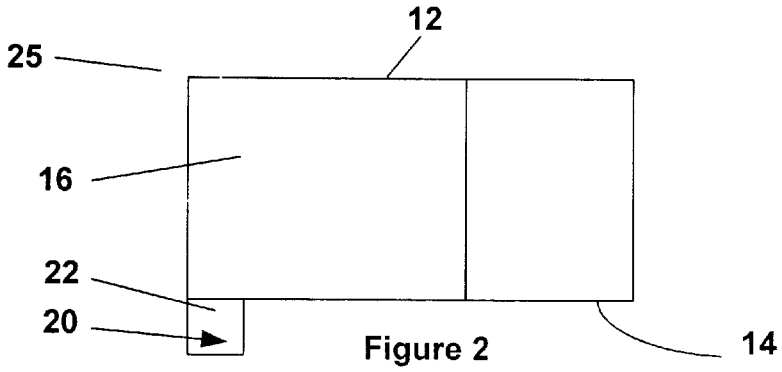
FIG. 2 is a side view of a deterioration resistant retaining wall block, which includes a retaining flange.

The bottom panel may also include or be adjoined to an anchoring device 20. FIG. 2 depicts the side view of an embodiment of the present invention, which includes an anchoring device 20 in the form of a retaining flange 22 adjoined to the bottom surface 14 of the block 10. On a constructed wall, each retaining flange 22 is a wall retention device that operates to inhibit outward movement of the wall. Normally, the retaining flange 22 extends downward from the back of the bottom panel 14 and rests against the back of the retaining block 10 located below the bottom panel 14. The retaining flange 22 may be a unitary piece extending downward from the back of the retaining block 10 or a series of fingers extending downward from the back of the retaining block 10.

Figure 3:
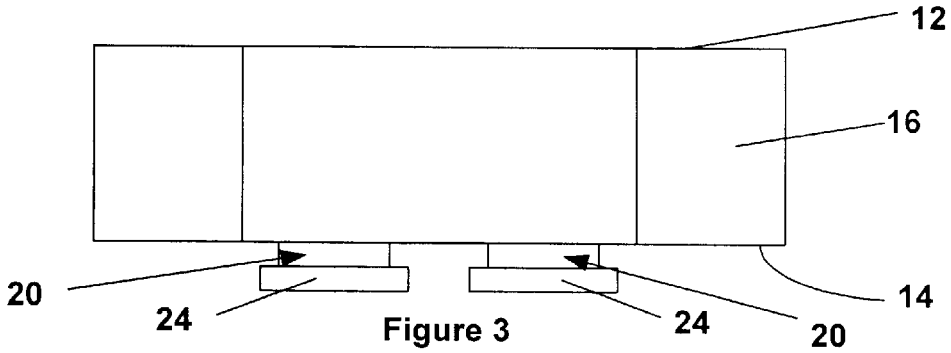
FIG. 3 is a front view of a deterioration resistant retaining wall block, which includes insertable pegs.
Figure 4:
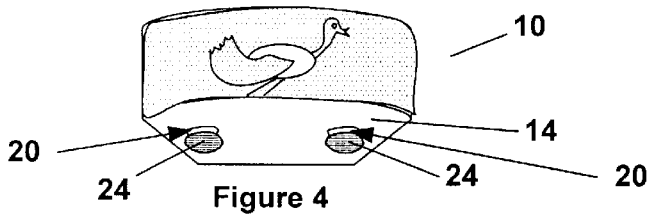
FIG. 4 is a perspective view of a deterioration resistant retaining wall block, which includes lockable insertable pegs.
Figure 5:
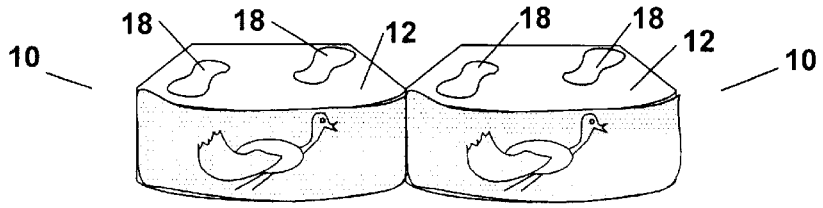
FIG. 5 is a perspective view of deterioration resistant retaining wall blocks, which includes apertures for receiving lockable insertable pegs.

Another embodiment of the present invention may include an anchoring device 20 in the form of insertable pegs 24. In FIG. 3 the insertable pegs 24 are adjoined to the bottom panel 14 and are configured to be securely receivable in the apertures 18 of an additional adjoining top panel 12 of another retaining block 10. The insertable pegs 24 can be made of any shape and size, which can be securely fit into the apertures 18 of the top panel 12. The insertable pegs 24 may also function to seal the interior of the retaining block 10 from outside elements. FIGS. 4 and 5 depict another type of peg configuration. FIG. 4 illustrates a bottom panel 14 of one embodiment of the present invention wherein the insertable pegs 24 are lockable. The insertable pegs 24 are positioned on the bottom panel 14 at an angled configuration. The top panel 12, illustrated in FIG. 5, includes apertures 18 adapted to receive the lockable insertable pegs 24. In operation a block 10 is maneuvered so that the pegs 24 of one block are inserted into the apertures 18 of another block. The block 10 possessing peg 24 is then turned into position thereby locking the two blocks together. The pegs 24 on a block 10 may also be configured to fit into the apertures of two adjacent blocks positioned below. This application is beneficial if the blocks of adjacent rows are staggered in positioning. See FIGS. 6A and 6B for an illustration of a staggered retaining wall.

The deterioration resistant retaining block 10 also includes a wall assembly 16, which is also depicted in FIG. 1. The wall assembly 16 comprises one or more outside walls 25. Many embodiments of the present invention include wall assemblies 16 that are adjoined to the top panel 12 and bottom panel 14. The adjoinment of the wall assembly 16 to the top panel 12 and bottom panel 14 creates a chamber 26 located within the retaining block 10. The chamber 26 is normally filled with materials such as sand, gravel, dirt, cement, water, or other like materials to provide weight and structure stability to the retaining block 10 and the entire retaining wall.

Figure 9:
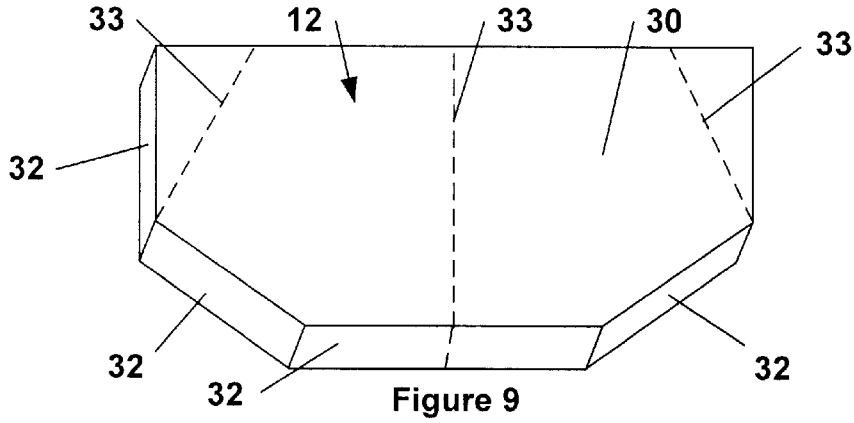
FIG. 9 is a perspective view of a cover of a deterioration resistant retaining wall block.
Figure 7:
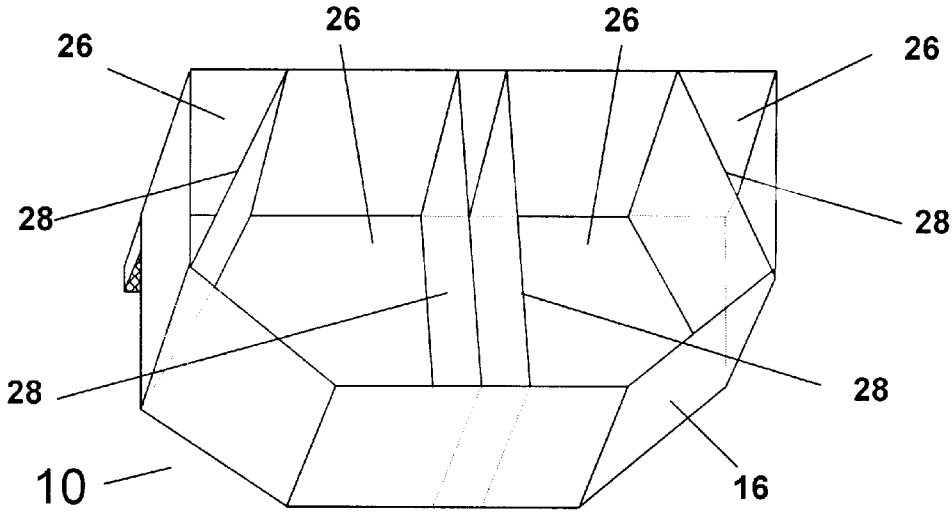
FIG. 7 is a perspective view of a deterioration resistant retaining wall block containing multiple chambers.
Figure 8:
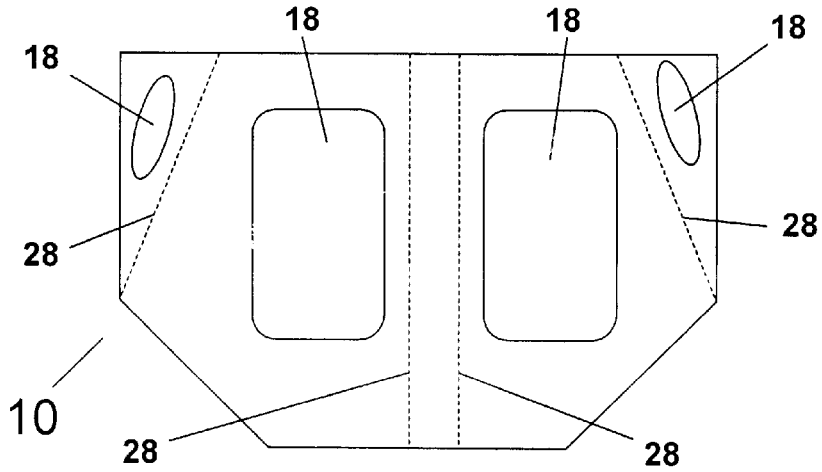
FIG. 8 is a top view of a multiple chamber deterioration resistant retaining wall block that includes a top panel with multiple apertures.

Another embodiment of the present invention is depicted in FIGS. 7–9. The embodiment shown in FIG. 7 comprises a deterioration resistant retaining block 10 with the top panel 12 removed, wherein the wall assembly 16 defines more than one chamber 26 within the retaining block 10. The multiple chambers 26 are defined by interior partitions 28. The interior partitions 28 may also be utilized to add additional support to the retaining block 10 to prevent any possible crushing of the block 10. FIG. 8 depicts one embodiment of the top panel of a partitioned retaining block 10. The interior partitions 28 are within the interior of the retaining block 10 and are depicted by dashed lines. The top panel 12 in this embodiment is permanently fixed to the wall assembly 16 and includes multiple apertures 18 to accommodate filling of each individual chamber 26 with appropriate fill material, such as sand, gravel, soil, cement or any other suitable material.

Figure 9A:
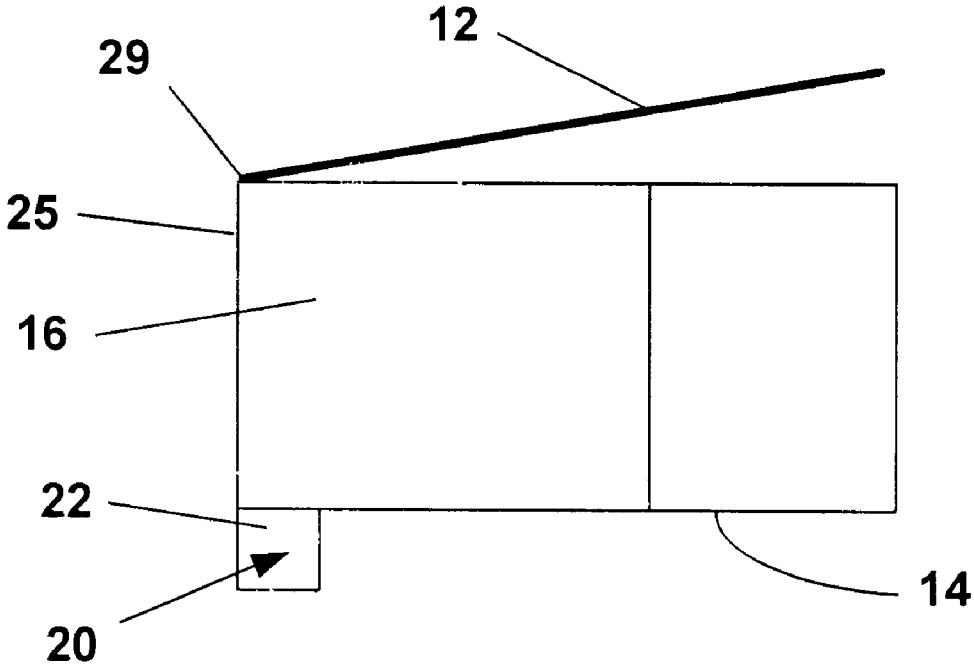
FIG. 9A is a side view of a deterioration restraint retaining wall block including a hingedly attached cover.

FIG. 9 depicts another possible embodiment of the top panel 12, which is configured in a cover formation that may be adapted to securely fit over the retaining wall block 10 illustrated in FIG. 7. The top panel 12 of this embodiment comprises a closed section 30 that includes overlapping edges 32, which overlap securely over the outside walls of the wall assembly 16, but does not include apertures. However, the top panel may also secure to the wall assembly 16 in other ways, such as locking tabs, twist locks, clamps, clips, adhesives or any other fastener. The top panel 12 of this embodiment may optionally be hingedly secured to the retaining block 10 by any type of hinge device 29, thereby providing a unitary configuration of the retaining wall block 10. FIG. 9A depicts one embodiment of the present invention including a top panel 12 hingedly adjoined to the wall 16 of the retaining wall block 10.

Figure 10:
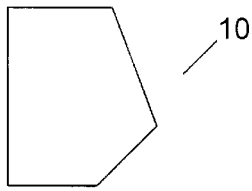
FIG. 10 is a top view of a section of a deterioration resistant retaining wall block.

Multiple chambers 26 also allow for the retaining block 10 to be cut into various shapes and still maintain a chamber that can receive and retain fill materials. FIG. 10 depicts a section of the retaining block 10 as shown in FIG. 7 wherein the corners have been removed and the block 10 has been cut in half. The ability to cut the retaining block 10 and still retain the same features is particularly useful in preparing ends and awkward segments of retaining walls. Dashed lines depicted in FIG. 9 illustrate alternate cover configurations to conform to the various shapes of a retaining block 10 or portions thereof.

Figure 6A:
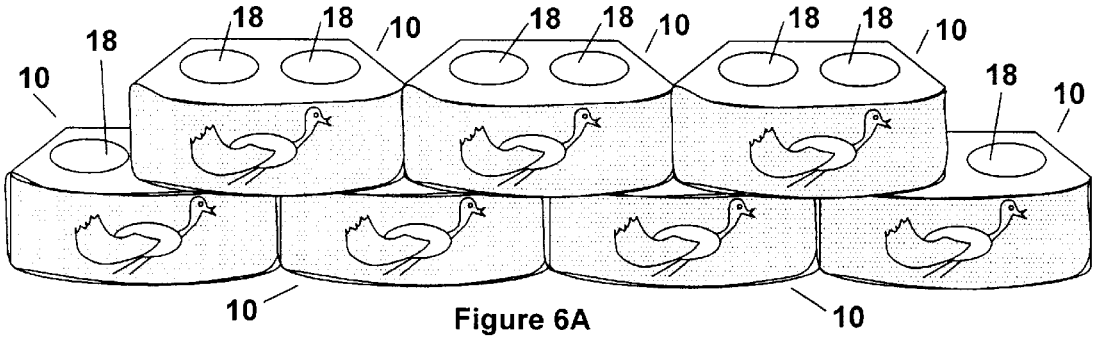
FIG. 6A is a perspective view of deterioration resistant retaining wall that includes staggered rows and molded designs on the front panel.
Figure 6B:
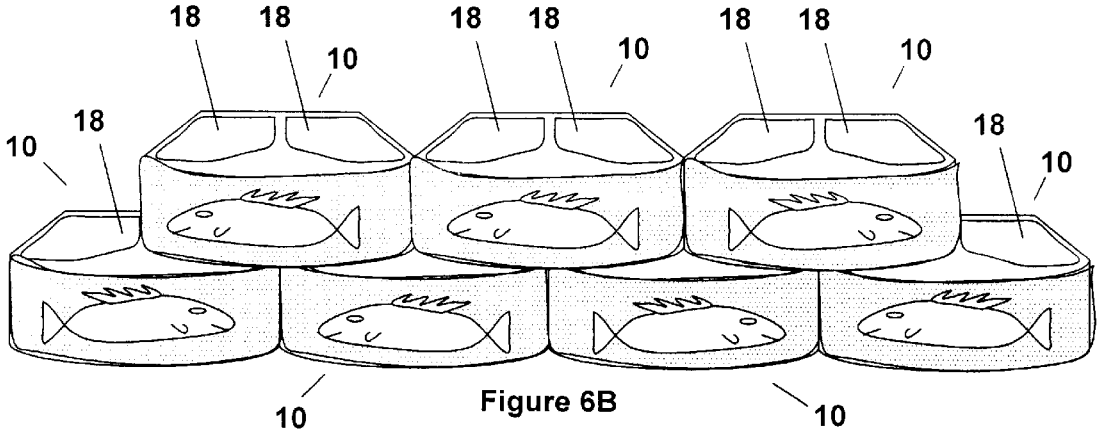
FIG. 6B is a perspective view of deterioration resistant retaining wall that includes staggered rows and molded designs on the front panel.
Figure 11:
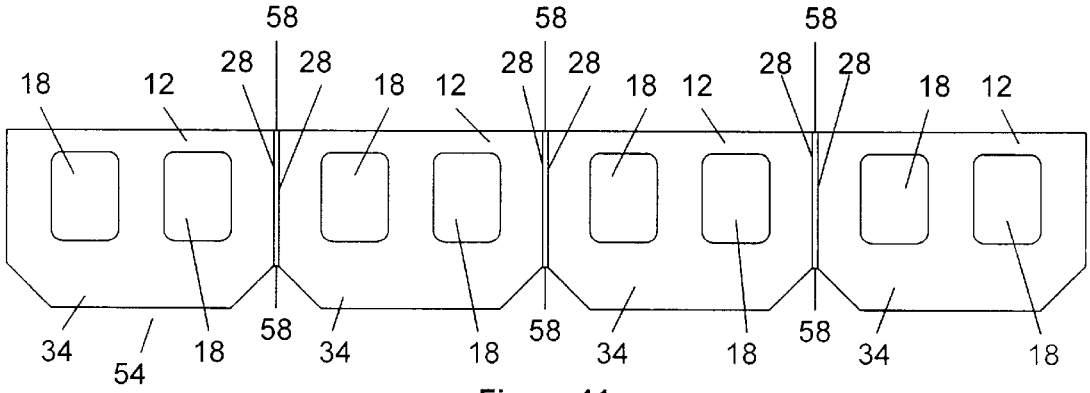
FIG. 11 depicts a top view of a multi-unit deterioration resistant retaining wall block.
Figure 12:
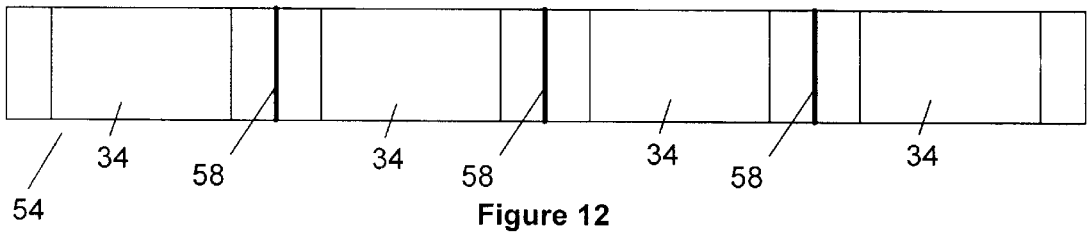
FIG. 12 depicts a front view of a multi-unit deterioration resistant retaining wall block.

An additional embodiment of the present invention is depicted in FIGS. 11 and 12. FIG. 11 illustrates a top view of a retaining block 54 wherein multiple units 34 are incorporated into a single block 54. A single multi-unit block 54 provides the appearance of multiple retaining blocks present in a single structure. The top panel 12 may be a single sheet or multiple sheets of material which covers each unit 34 and optionally includes apertures 18. The interior of the retaining block 54 of this embodiment includes one or more interior partitions 28. FIG. 12 depicts the front view of the mutli-unit retaining block 54, which has the appearance of multiple separate units 34. These multiple separate units 34 provide the appearance similar to the partial assembly of a retaining wall comprising a plurality of individual blocks, such as depicted in FIGS. 6A and 6B. The multi-unit retaining block 54 may be a unitary structure or may include multiple components, such as a multi-unit block 54 including a single top panel (not shown), similar to the top panel depicted in FIG. 9.

Figure 13:
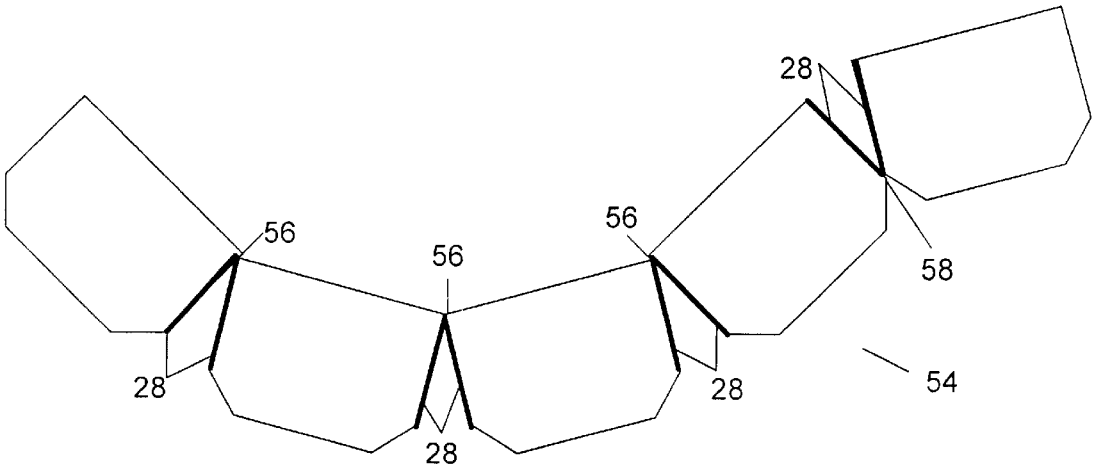
FIG. 13 depicts a top view of a multi-unit deterioration resistant retaining wall block with disengaged tabs.
Figure 14:
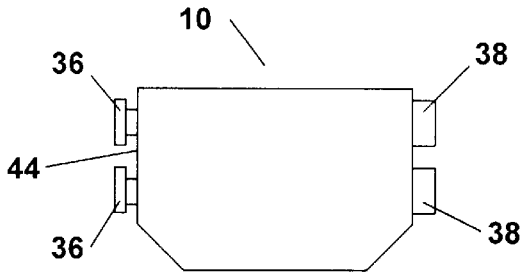
FIG. 14 depicts a top view of a deterioration resistant retaining wall block that includes interlocking keys and locks.
Figure 15:
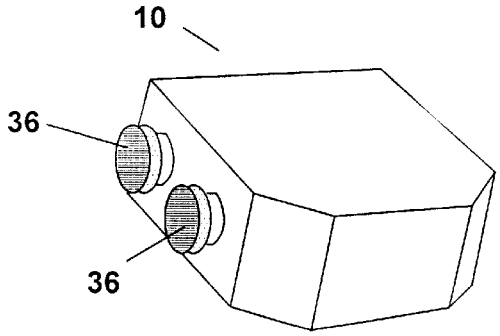
FIG. 15 depicts a left side perspective view of the deterioration resistant retaining wall block of FIG. 14.
Figure 16:
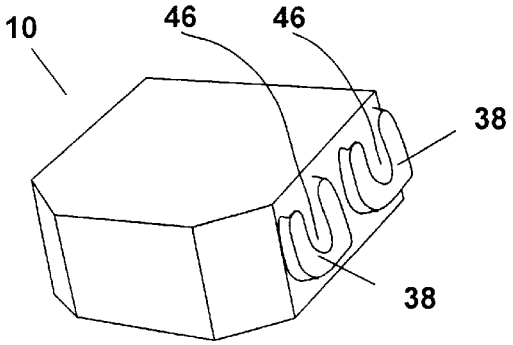
FIG. 16 depicts a right side perspective view of the deterioration resistant retaining wall block of FIG. 14.
Figure 17:
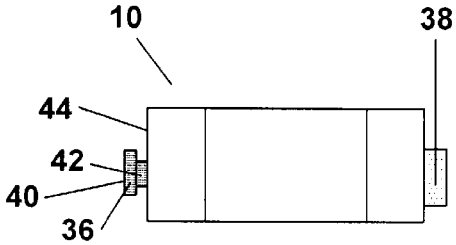
FIG. 17 depicts a top view of the deterioration resistant retaining wall block of FIG. 14.

FIG. 13 depicts another embodiment of a multi-unit retaining wall block 54, which includes a common flexible wall 56. For example flexible wall 56 may be positioned as the back wall of the multi-unit block 54. In this embodiment of the present invention, tabs 58 may be positioned between each individual unit 34 on the front or back of the multi-unit block 54. If a curved wall is desired, the tabs 58 may be disengaged, thereby allowing the multi-unit block 54 to be maneuvered into a curved position.

Figure 18:
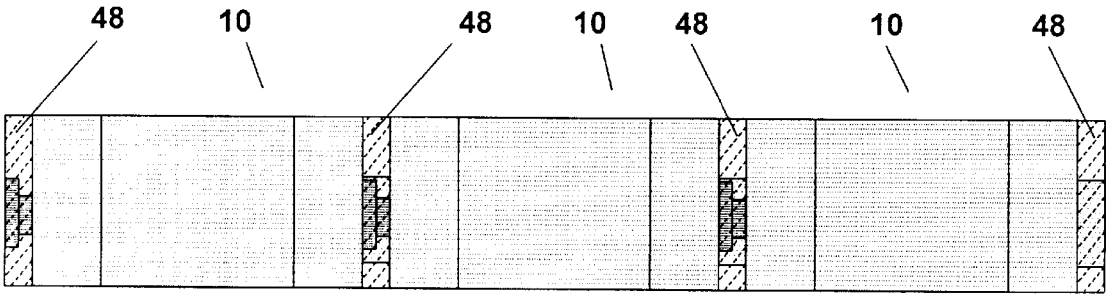
FIG. 18 depicts a front view of a deterioration resistant retaining wall incorporating wings that cover the interlocking keys and locks.

Another type of anchoring device 20 included in the present invention may be a side locking mechanism. As depicted in FIGS. 14–17 one or more interlocking keys 36 and locks 38 may be included in the retaining block. Each key 36 may include a rounded relatively flat cylinder 40 adjoined to a neck 42 that is attached to the side wall 44 of a retaining block 10. Each lock 38 comprises a partially enclosed cavity 46, which is configured to receive and securely retain the key 36 when inserted into the lock 38. As depicted in FIG. 18., wings 48 located on the front of each retaining block 10 function to hide the key and lock system from the view of an observer of the retaining wall. The retaining wall blocks of the present invention may include other side attachments, such as hook and pile attachments (not shown).

Figure 19:
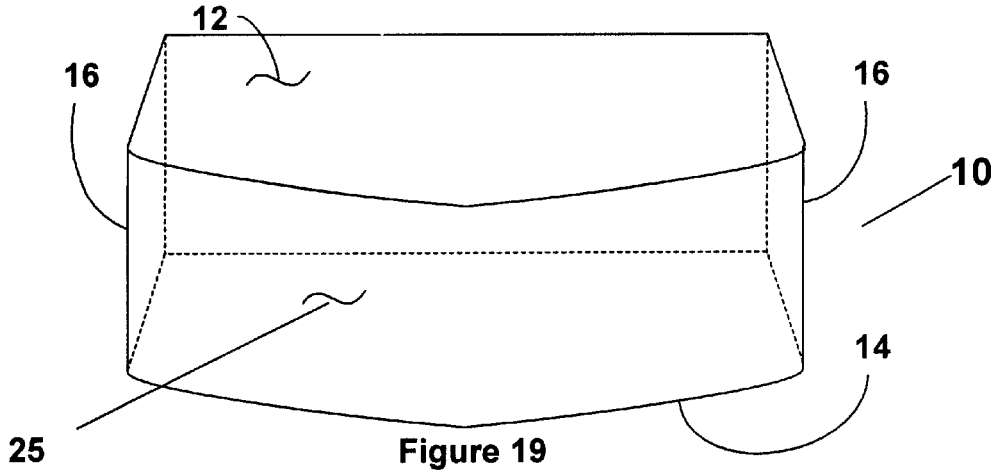
FIG. 19 depicts a perspective view of a deterioration resistant retaining wall block with a back panel aperture.
Figure 20:
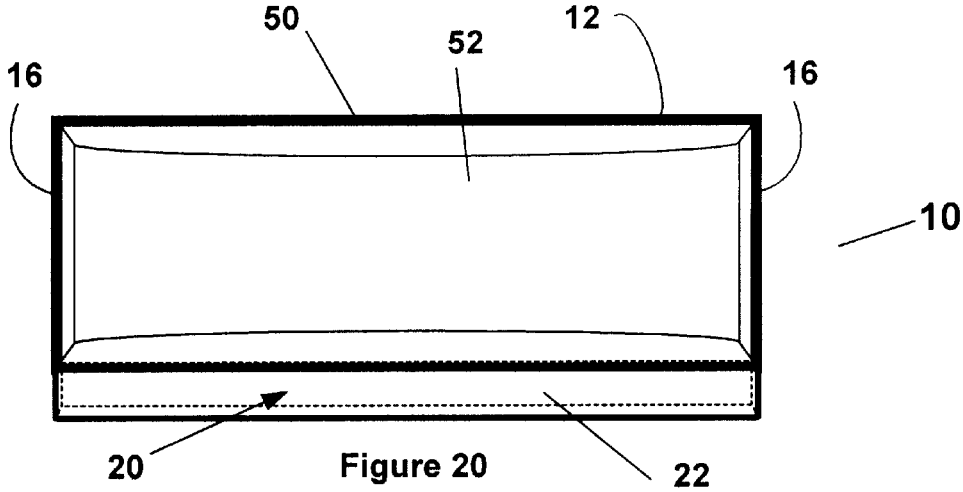
FIG. 20 depicts a front view of a deterioration resistant retaining wall block with a back panel aperture.
Figure 21:
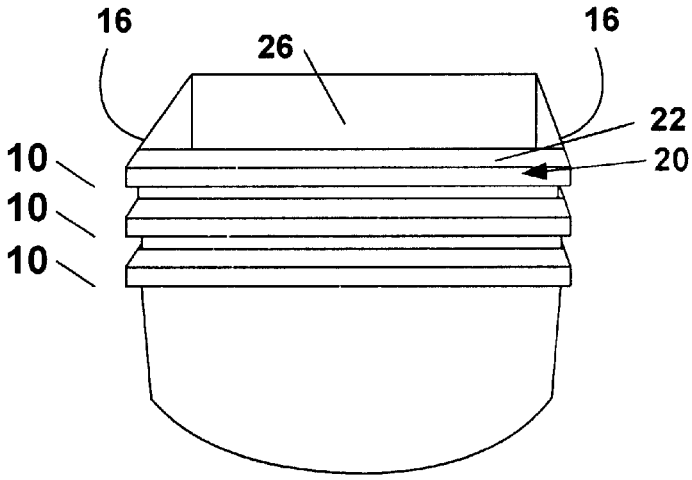
FIG. 21 depicts a perspective view of more than one stackable deterioration resistant retaining wall blocks.

The retaining wall block 10 depicted in FIGS. 19–21 includes a top panel 12, a bottom panel 14 and a wall assembly 16 configured to form one or more chambers 26. The top panel 12 and bottom panel 14 do not include apertures. Furthermore, the top panel 12, bottom panel 14 and wall assembly 16 may be a unitary structure or piece. The difference in this embodiment is that the back wall 50 includes one or more back apertures 52 that can be sealed, after it is filled, with a cover or other type of plugging device (not shown). The back apertures 52 can be of any shape and size and may include an aperture that may extend to any or all of the side panels 16, top panel 12 and/or bottom panel 14. The embodiment depicted in FIGS. 19–21 may also include an anchoring device, such as a retaining flange 22 or any other type of anchoring device. The embodiment of the present invention as depicted in FIGS. 19 is preferably used when retaining walls are embedded into or positioned flush with a hill or other type of ridge thereby further sealing the one or more apertures. The retaining wall block 10 may be filled with a filling material from the back and then placed into position on the retaining wall. Once in position on the retaining wall, the fill material utilized to secure and weight the retaining wall block is maintained within the chamber 26 by the cover or plug and further by the soil, sand, gravel, rock or similar material, which makes up the hill or ridge. An embodiment including multiple units (not shown) may also incorporate into the structure a back panel with an aperture. The presence of an aperture positioned in the back wall 50 may also allow for easy storage and transport due to the stackable capabilities present. For example, an individual block 10 may be inserted into the back of another block 10, thereby creating a stackable arrangement.

Figure 22:
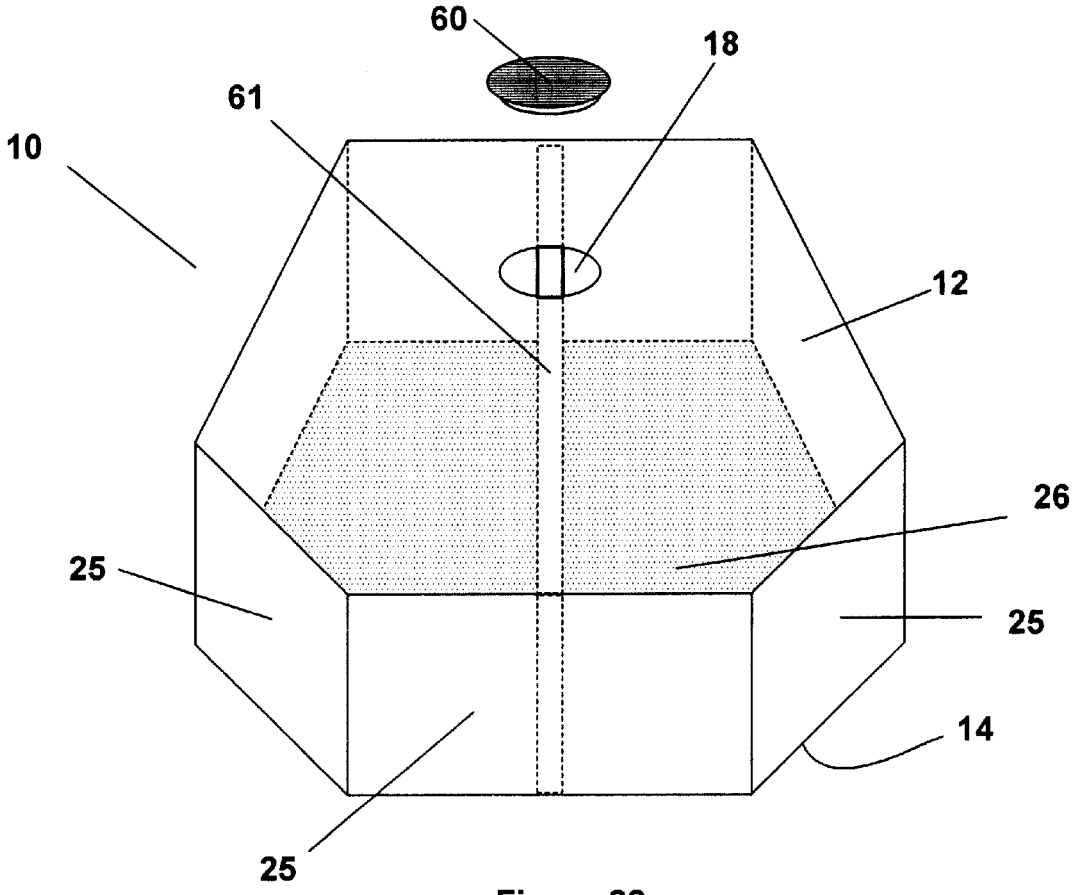
FIG. 22 depicts a perspective view of a deterioration resistant retaining wall block with an expansion chamber and sealing cap.

Another embodiment of the present invention, as depicted in FIG. 22, illustrates a retaining block 10 wherein an aperture 18 may be sealed with a sealing device 60, such as a cap or plug, after filling the block 10 with an appropriate fill material, such as a liquid. The sealing device 60 may be sealed in a variety of ways known in the art such as screw caps, snap caps, press fit caps, locking caps or any other similar sealing means. For example, the embodiment of FIG. 22 may be filled with water and then sealed with a cap 60 thereby preventing loss of the fill material and providing the weight necessary to give the block 10 stability. In one embodiment, the block 10 may or may not include an expansion chamber 61, which would allow for expansion of the liquid in situations such as freezing. Embodiments of the expansion chamber 61 may include one or more flexible panels within the chamber or a flexible bladder inserted within the chamber. Alternatively, the utilization of water or other liquids susceptible to freezing may include an adequate amount of antifreeze to prevent freezing of the fill material in cold climates.

Various embodiments of the present invention, such as those depicted in FIGS. 19–21, also provide for ease in transport and storage due to stackable features. An additional example of a stackable retaining block 10 may be similar to that as shown in FIG. 1, wherein the top panel 12 is removable and allows for the retaining block to be inserted within the chamber of another block. The top panel 12 for such a retaining block 10 may include a cover similar to the cover shown in FIG. 9.

As previously mentioned, the present invention may be manufactured from a deterioration resistant, substantially rigid composite or polymeric material including, but not limited to, plastic, a rubber composition, fiberglass, or any other similar material or a combination thereof. Preferable materials comprise light-weight and slightly flexible. Generally, the embodiments of the present invention may comprise any type of material that would have the similar characteristics to plastic, vinyl, silicone, fiberglass, rubber or a combination of these materials. It is noted that the material utilized in the present invention should be rigid enough to hold its form upon addition of filling material and also when placed in contact with other objects. Another preferable material may be comprised of a material similar to that utilized in the production of some types of garbage cans or the utilization of recycled rubber from objects such as tires. Such materials would be capable of holding rigidity and still offer flexibility when placed in contact with other objects, such as ice. Also, such materials have the ability to regain its original form when the object or material has been removed.

Embodiments of the present invention may also vary in appearance. Since embodiments of the present invention may be manufactured by a process such as injection molding, the molds may include any type of design or shape. Furthermore, the front panels of the retaining wall block 10, as shown in FIGS. 4, 5 and 6A–B, could be molded in almost any type of configuration. In one embodiment, multiple retaining wall blocks could be molded to include designs that, when positioned on a retaining wall, would complete a larger single design, such as the spelling of a company or school name in large letters or the completion of a large image. Also, since the present invention may be manufactured from a number of different products, such as plastic, a rubber composition or fiberglass, the retaining wall block may comprise any color or a multitude of colors. For example, a retaining wall installed in a beach setting may be manufactured of a plastic or rubber product and be colored in so that organic matter wash up on it would not show up as readily.

As previously suggested the environment resistant retaining wall block is utilized in the construction of any type of wall or border. In application, a foundation is first created in the area that the wall or border is to be constructed. The foundation preferably is flat and or level and can accommodate one or more retaining blocks 10. Once a foundation is completed, a first row is laid by filling each individual retaining block 10 with a fill material and placing each individual or multi-unit block, side by side until the row is completed. The filling of the retaining wall block gives it the added weight that it needs to retain its structure and hold it in place. A funneling device may be utilized, which fits securely into the openings or apertures of the retaining wall block to guide fill into the chamber of the block. The first row may be straight or rounded. An example of a rounded first row is depicted in FIG. 20. Upon completion of the first row, additional rows are constructed by performing the same filling process and placing the retaining wall block 10 in the proper position until a continuous retaining wall is completed. Generally, a continuous retaining includes stacked rows wherein individual retaining blocks are placed adjacently to one another thereby eliminating or minimizing cracks or gaps in the wall. Retaining wall blocks 10 may be positioned directly over other retaining wall blocks 10 in lower rows or may be staggered. It is noted that each retaining wall block placed in the retaining wall may be configured to retain and seal the contents of the fill material. This is accomplished by either one or more plugs or covers that seals each open aperture or by enclosing an open aperture with a portion of an adjacent block. Furthermore, the retaining wall blocks 10 of the upper rows may overlap the back of retaining wall blocks 10 of lower rows if a retaining flange 24 is included on the block. In the alternative or additionally, each individual retaining block 10 may be locked into position with adjacent blocks if pegs 24 and apertures 18 or keys 36 and locks 38 are present on the retaining block 10. Upon completion of the top row of the retaining wall, a cover may be placed over the top row to close the apertures 18 of the top panels 12 or to provide a finishing border to the top of the retaining wall.

Embodiments of the present invention may also be used in conjunction with regular keystone bricks or stones. A retaining wall constructed in water or along a waterfront property may utilize the retaining wall block of the present invention at water level and below and then the regular keystone or retaining wall materials can be used on top of the retaining wall block of the present invention. The utilization of the retaining wall block of the present invention would be easy to match colors with the conventional retaining wall building materials because the materials utilized to manufacture the present invention can be colored and designed to match virtually any type of retaining wall construction material.

Furthermore, the retaining wall block may be manufactured in a multitude of different sizes, shapes and configurations. For example, an embankment or steep shoreline could support a retaining wall configured in a step like arrangement or design. Such a structure, may be utilized as a retaining wall and/or a stairway down to the beach or to the water.

While the invention has been illustrated and described in detail in the drawings and foregoing description, such an illustration and description is to be considered as exemplary and not restrictive in character, it being understood that only the preferred embodiments have been shown and described and that all changes and modifications that come within the spirit of the invention are desired to be protected.

What is claimed is:

1. A method of constructing a deterioration resistant retaining wall comprising establishing a foundation that can support more than one deterioration resistant blocks, said deterioration resistant blocks comprised of a deterioration resistant composite or polymeric material and including a top panel and bottom panel that are adjoined to a wall assembly to form a sealable chamber for receiving and retaining a fill material;

filling more than one retaining blocks with a fill material;

placing one or more retaining blocks side by side on the foundation to generate a straight or curved row; and stacking one or more rows with each row stacked upon the row below it to form a continuous retaining wall.

2. The method of constructing a deterioration resistant retaining wall of claim 1, wherein the rows are staggered.

3. The method of constructing a deterioration resistant retaining wall of claim 1, wherein the individual retaining blocks are engaged by anchoring devices.

4. The method of constructing a deterioration resistant retaining wall of claim 1, wherein the anchoring devices are selected from a group consisting of retaining flange, pegs and locking mechanisms.

5. The method of constructing a deterioration resistant retaining wall of claim 1, wherein the retaining wall is constructed on a waterfront and all or a portion of said retaining wall extends into water.

6. The method of constructing a deterioration resistant retaining wall of claim 1 wherein the composite or polymeric material is one or more materials selected from the group consisting of plastic, vinyl, silicone, rubber, fiberglass or any combination thereof.

7. The method of constructing a deterioration resistant retaining wall of claim 1, wherein the top panel, bottom panel or wall assembly includes one or more apertures.

8. The method of constructing a deterioration resistant retaining wall of claim 1, wherein the apertures are sealed with a sealing device.

9. The method of constructing a deterioration resistant retaining wall of claim 8, wherein the sealing device is a cap or plug for retaining a liquid in the chamber.

10. The method of constructing a deterioration resistant retaining wall of claim 1, wherein the deterioration resistant block further includes one or more expansion chambers.

11. The method of constructing a deterioration resistant retaining wall of claim 1, wherein the top panel, bottom panel or wall assembly includes a removable or hingedly adjoined cover.

12. The method of constructing a deterioration resistant retaining wall of claim 1, wherein the blocks further include one or more interior partitions.

13. The method of constructing a deterioration resistant retaining wall of claim 1, wherein the blocks further include more than one unit.

14. The method of constructing a deterioration resistant retaining wall of claim 1, wherein the blocks further include one or more disengaging tabs.

15. The method of constructing a deterioration resistant retaining wall of claim 1, wherein the blocks further include one or more anchoring devices.

16. The method of constructing a deterioration resistant retaining wall of claim 15, wherein the anchoring devices are selected from a group consisting of retaining flanges, and pegs and locking mechanisms.

17. The method of constructing a deterioration resistant retaining wall of claim 1, wherein the fill material is one or more materials selected from a group consisting of sand, gravel, dirt, crushed rock, pea rock, concrete, water and antifreeze.

18. The method of constructing a deterioration resistant retaining wall of claim 1, wherein each block is a unitary structure.

19. The method of constructing a deterioration resistant retaining wall of claim 1, wherein the blocks further include one or more designs.

20. The method of constructing a deterioration resistant retaining wall of claim 1, wherein the designs of each block create a larger design when the blocks are assembled into the retaining wall.

* * * * *